United States Patent [19]

Bschorr

[11] 4,325,461

[45] Apr. 20, 1982

[54] NOISE REDUCING RESONATORS, OR SO-CALLED SILATORS

[75] Inventor: Oskar Bschorr, Munich, Fed. Rep. of Germany

[73] Assignee: Messerschmitt-Boelkow-Blohm Gesellschaft mit beschraenkter Haftung, Munich, Fed. Rep. of Germany

[21] Appl. No.: 205,922

[22] Filed: Nov. 12, 1980

[30] Foreign Application Priority Data

Nov. 22, 1979 [DE] Fed. Rep. of Germany ..... 2947026

[51] Int. Cl.[3] ..... G10K 11/16

[52] U.S. Cl. ..... 181/286; 181/288; 181/291

[58] Field of Search ..... 181/286, 288, 289, 290, 181/291, 295; 52/144

[56] References Cited

U.S. PATENT DOCUMENTS 2,710,335 6/1955 Wong ..... 181/289

4,228,868 10/1980 Bschorr ..... 181/286

FOREIGN PATENT DOCUMENTS 2834823 10/1979 Fed. Rep. of Germany ..... 181/288

*Primary Examiner*—L. T. Hix

*Assistant Examiner*—Thomas H. Tarcza

*Attorney, Agent, or Firm*—W. G. Fasse; D. H. Kane, Jr.; D. F. Gould

[57] ABSTRACT

A noise reducing resonator, herein referred to as a silator due to its noise silencing quality, is made up of primary struts forming a main frame and secondary struts forming at least one subframe enclosed by a vacuum tight cover to enclose a vaulting evacuated volume. Each frame has a given span width and a vaulting height corresponding to 0.005 to 0.05 times the respective span width. The frames are arranged in a hierarchic order which means that a larger main frame holds a smaller subframe which in turn holds a still smaller subframe and so on. The resonance frequency increases with the number of subframes held in a main frame. Interconnected silators may cover entire surface areas for noise reduction or absorption.

7 Claims, 9 Drawing Figures

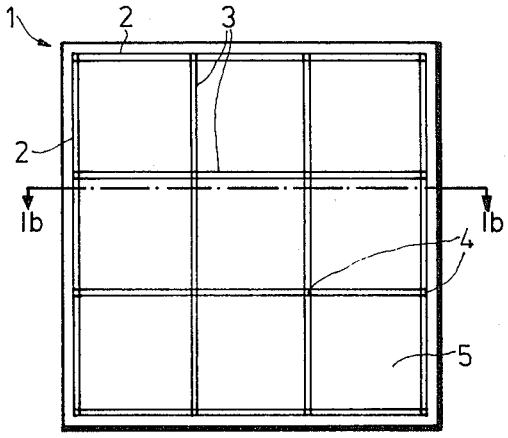
Fig. 1a
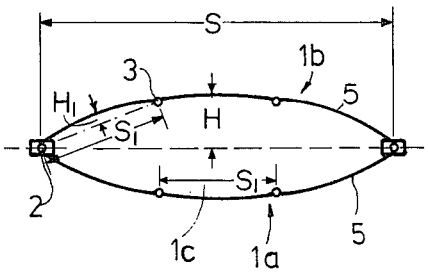
Fig. 1b
Fig. 2a
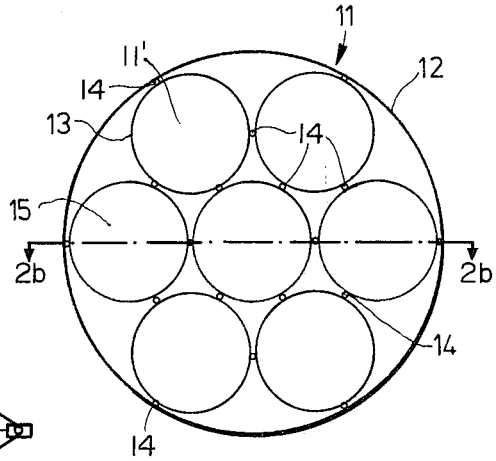
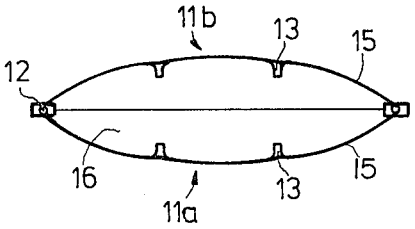
Fig. 2b

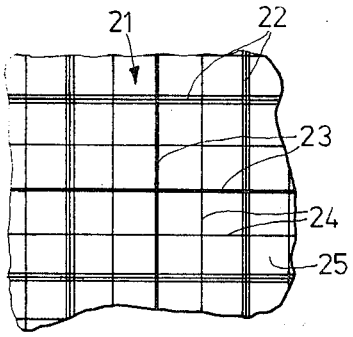
Fig. 3
Fig. 4
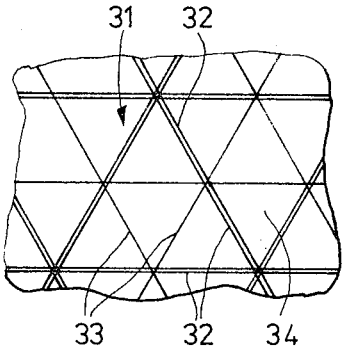
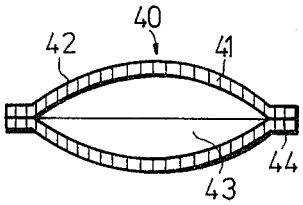
Fig. 5
Fig. 6
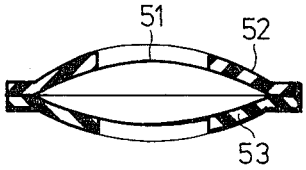
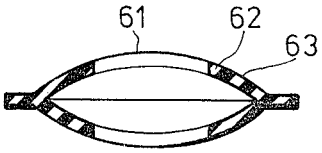
Fig. 7

NOISE REDUCING RESONATORS, OR SO-CALLED SILATORS

CROSS-REFERENCE TO RELATED APPLICATION

The present application corresponds to German Patent Application No. P 2,947,026.6-52, filed in the Federal Republic of Germany on Nov. 22, 1979. The priority of said German filing date is hereby claimed.

BACKGROUND OF THE INVENTION

The invention relates to a noise reducing apparatus comprising resonators or so-called silators.

German Patent Publication (DE-OS) No. 2,632,290.7 discloses a basic construction of so-called silators which may be defined as vibrating resonators changing their volume and thereby having a silencing effect. These silators comprise two lentil shaped, vaulted sheet metal halves interconnected in a vacuum tight manner. The space formed inside the vaulting is evacuated. Such silators have a resonance frequency which may be adjusted substantially by selecting the wall thickness, the vaulting height, and the diameter of the lentil shaped silators.

So-called Helmholtz resonators are also well known in the art for noise reduction purposes. However, Helmholtz resonators require, as compared to silators, a substantially larger volume and surface area which limits the use of such Helmholtz resonators.

OBJECTS OF THE INVENTION

In view of the above it is the aim of the invention to achieve the following objects singly or in combination:

to further reduce the surface area and volume of so-called silators, especially of the Helmholtz resonator type by an order of magnitude;

to subdivide the silators to thereby more effectively use the available surface area by a factor corresponding substantially to the number of subdivisions; and to arrange a plurality of silators in a hierarchic order so that a larger silator supports a smaller silator and so forth.

SUMMARY OF THE INVENTION

According to the invention there is provided a noise reducing resonator or so-called silator which vibrates with the noise to be reduced, thereby changing their volume to absorb the noise. A basic or main frame is formed by primary struts having a given span width. Secondary strut members form at least two subframes vaulting over the span width to form a vaulting height corresponding to substantially 1/200 to 1/20 of said free span width. The secondary strut members in turn may be subdivided, whereby again each subdivision strut member has a given span width and a vaulting satisfying the above ratio relative to its span width. A vacuum tight cover encloses the just described frame structure and the volume so enclosed is evacuated. The cover may be formed of sheet metal, synthetic materials, or other suitable materials. The interconnection of the frame structures may be accomplished by suitable adhesives, spot welding, or the like. The cover is also secured to the frame structures by adhesives or the like.

By arranging the frame structures in such a manner that a larger frame carries a smaller frame which in turn carries a still smaller frame a hierarchic subdivision of the silators is achieved so that the main silator of the first stage carries or has integrated therein a plurality of subsilators, whereby the surface utilization is doubled. Thus, it will be appreciated, that according to the invention with a subdivision factor n the surface utilization also corresponds to the same factor n.

BRIEF FIGURE DESCRIPTION

In order that the invention may be clearly understood, it will now be described, by way of example, with reference to the accompanying drawings, wherein:

FIG. 1*a* is a top plan view of a silator according to the invention in a schematic illustration, wherein the subdivision factor also referred to as hierarchy factor is 2;

FIG. 1*b* is a sectional view along section line 1*b*—1*b* in FIG. 1*a*, again showing a simplified illustration;

FIG. 2*a* is a top plan view of a silator having a circular configuration with subsilators also of circular shape, whereby again the subdivision factor is 2 because there is the main silator and one set of subsilators;

FIG. 2*b* is a sectional view along section line 2*b*—2*b* in FIG. 2*a;*

FIG. 3 shows a top plan view, partially broken away, of a silator arrangement in which each silator has a square outline and wherein the main silator carries a subgroup of silators which in turn carry subgroups of silators, thereby providing a triple, stepped, hierarchy arrangement;

FIG. 4 shows a top plan view of a double hierarchy arrangement of triangular silators;

FIG. 5 is a sectional view through a single silator element in which the covering walls form a so-called honeycomb structure shown schematically;

FIG. 6 is a schematic sectional view through a silator element having damping means secured thereto externally along the edges thereof; and FIG. 7 is a sectional view to that of FIG. 6, however, showing a different, internal arrangement of the damping means along the edges of the silator element.

DETAILED DESCRIPTION OF PREFERRED EXAMPLE EMBODIMENTS AND OF THE BEST MODE OF THE INVENTION

FIGS. 1*a* and 1*b* show a silator arrangement according to the invention in which the square outline is subdivided into a double hierarchy of silator elements, a square main frame 1 is formed by four primary struts 2 operatively interconnected at the corners, for example, by adhesive or welding or the like. The main frame 1 has a span width S as shown in FIG. 1*b*.

Secondary strut members 3 subdivide the area defined by the main frame 1, for example, into nine subframes. The secondary strut members 3 are operatively interconnected at the junctions 4 with one another and with the main frame, for example, by an adhesive or by spot welding. The secondary strut members 3 form subframes having a span width S1 also as shown in FIG. 1*b*. The subframes are so arranged that they form two vaults 1*a* and 1*b* over the main frame 1. Each vault 1*a*, 1*b* has a vaulting height H. Additionally, the individual secondary strut members 3 form subvaults over the subspan width S1. Each subvault has a vaulting height H1.

The interconnection of the secondary strut members 3 at the junctions 4 is accomplished in a force and moment transmitting manner. Additionally, due to the individual vaulting of the secondary strut members 3 a quilted type pillow structure is accomplished which is covered by cover means 5 such as sheet metal, synthetic foil materials, or the like. The two vaults 1*a*, 1*b* enclose a volume 1*c* which is evacuated.

The vaulting height H, H1 and so forth should correspond to x times the respective span width S, S1 and so forth, whereby x is within the range of 0.005 to 0.05 of the respective span width. Preferably the cover means such as sheet metal or foil and also the primary and secondary strut members 2, 3 and so forth, are made of a material having a high modulus of elasticity and a small specific weight. It has been found that suitable materials include beryllium, aluminum, steel sheet metal, glass or carbon fiber reinforced synthetic compound materials, and also certain ceramic materials. The surface area subdivided by the secondary strut members 3 forms resonators or subsilators which have in the range of their resonance frequency, an impedance break or interruption, thereby accomplishing the desired noise attenuation or reduction. Depending on the manufacturing accuracy or precision, the resonance frequencies of the individual subsilators may be adjusted to different frequencies, thereby assuring a wide-band noise attenuation or deadening. Additionally, the primary strut members 2 form a main silator which has its own resonance frequency independent of the resonance frequency of each subsilator. Stated differently, all the primary strut members 2 as a unit form said main silator which may be adjusted to a given frequency and the secondary strut members 3 form a plurality of subsilators each having its own different resonance frequency. It has been found to be suitable to tune the subsilators to a high resonance frequency while tuning the larger or main silator formed by the primary strut members 2 and by the strut members 3 as a unit to a lower resonance frequency. Thus, due to the hierarchic arrangement as described, it is possible to utilize the available surface area twice, so to speak, in the structure illustrated in FIGS. 1*a* and 1*b*.

FIGS. 2*a* and 2*b* show a structure similar to that just described with reference to FIGS. 1*a* and 1*b*, except that in FIGS. 2*a* and 2*b* the main silator 11 and the subsilators 11' are circular. The primary strut member 12 is a round hoop and the secondary strut members 13 forming the silators 11' are also round hoops, however, of smaller diameter. The hoops 12 and 13 are interconnected with one another as shown at 14 by adhesive means or by welding or the like. The entire structure is vaulted as shown in FIG. 2*b* to enclose a volume 16 by means of respective covers 15 of the same types of materials as mentioned above. Each half 11*a* and 11*b* has such a vaulted shape that they form the lentil shape body shown in FIG. 2*b*. The two halves 11*a* and 11*b* are interconnected in a vacuum tight manner so that the internal space 16 may be evacuated. The above described vaulting relationships apply also in this embodiment. Thus, the noise reduction or deadening effect is the same as in the first described embodiment and the surface areas vaulting over the secondary struts 13 also form subsilators and the entire structure with the primary strut 12 forms a main silator. Here again the surface utilization is substantially doubled as compared to prior art structures.

FIG. 3 shows an embodiment with a triple hierarchic subdivision. A square shape is used for all the silators to facilitate the illustration. The struts 22 form a square, plain base frame for a silator 21. Secondary strut members 23 subdivide the main silator 21 into four subsilators, whereby the individual struts 23 are vaulted, whereas the struts 22 are straight. The individual squares formed by the secondary struts 23 are further subdivided by additional secondary struts 24 to form a third group of subsilators in each of the squares formed by the struts 23. Thus, the main silator comprises one square. The first secondary silators comprise four squares with vaulted struts 23 and the third group of silators comprise a total of sixteen silator elements formed by vaulted struts 24. The entire structure is covered by cover means 25 of the type of materials mentioned above. Further, two halves are again formed and interconnected to enclose a vacuum tight volume which is evacuated as described. In this triple hierarchy system of silators the silator 21 has the lowest frequency and the resonance frequencies of the subsilators is higher for the second group and still higher for the third group.

FIG. 4 shows an example embodiment in which a double subdivision is accomplished by triangularly shaped silators. Main silators 31 are formed by struts 32 providing a frame for the subsilators enclosed by the primary strut members 32 and formed by the secondary strut members 33. Thus, each main silator 31 encloses four silators formed by the secondary strut members 33. Here again the intersecting or junction points are operatively interconnected in a force and moment transmitting manner by adhesives or welding or the like. The secondary struts are again vaulted whereby the vaulting height satisfies the above condition relative to the free span width between adjacent junctions.

In FIG. 4 a covering 34 is secured to the struts 32, 33 in a vacuum tight manner and again two halves are secured to each other so that the formed spaces between the silator cover means 34 may be evacuated.

FIG. 5 shows a single silator 40 having covers 41 formed of so-called honeycomb structures. Each honeycomb structure has outer surface sheet material and the honeycomb structure proper enclosed between the outer surface sheet material. Such structures are conventional as such. Two such surface structures enclose a volume 43 which is sealed in a vacuum tight manner along the edges 44, for example, by adhesive and the like. Again, the vaulting height corresponds to the above given range of the span width which in this instance corresponds to the diameter of the silator 40. By properly selecting the vaulting height and/or the free diameter of these silators, their resonance frequency may be adjusted and a wide frequency range may be covered by interconnecting a plurality of silators of different free diameters and/or different vaulting heights.

FIG. 6 shows a silator with cover means 51 and a damping material 53 clamped in around the edges between silator walls 51 and a counter sheet metal 52.

In FIG. 7 the silator walls 61 cooperate with wedging walls 62 to clamp a damping material 63 in place along the edges of the silator, however, inside thereof.

Additionally, any one or all of the described structures can be provided with a so-called anti-noise or anti-hum coating such as a polyurethane lacquer which simultaneously may constitute a protective coating against corrosion or for decorating or color coding purposes.

Incidentally, the dimensions of the primary and secondary strut members as far as length, width, and height is concerned will preferably have a fixed relationship from one group to the other. For example, a secondary strut may be half as long as the primary strut and similarly will the width and height be reduced. The present structure achieves an optimal surface area utilization for the intended purpose by the hierarchic arrangement of the silators and subsilators.

Although the invention has been described with reference to specific example embodiments, it will be appreciated that it is intended to cover all modifications and equivalents within the scope of the appended claims.

What is claimed is:

1. A noise reducing apparatus, comprising resonance means including primary strut members (2) forming a main frame having a given span width, a number of secondary strut members (3) forming a plurality of subframes, junction means operatively interconnecting said main frame and said subframes, each of said subframes also having a respective span width, said main frame and said subframes forming vaults having a vaulting height corresponding to "x" times the corresponding span width, wherein x is within the range of 0.005 to 0.05, and vacuum tight cover means operatively supported by said main frame and by said subframes, said cover means enclosing a substantially evacuated inner volume, said primary strut members (2) forming with the cover means a main silator having a given resonance frequency, said secondary strut members (3) with the same cover means forming a plurality of subsilators each having its own resonance frequency, whereby the surface area of said cover means is utilized in a multiple manner.

2. The apparatus of claim 1, wherein said primary and secondary strut members and said cover means are made of materials having a high modulus of elasticity and a low specific weight, and wherein said junction means interconnect said main frame, said subframes and said cover means in a force and moment transmitting manner.

3. The apparatus of claim 1 or 2, wherein said subframes form a plurality of subframe groups which are so arranged that a first subframe group is carried by the main frame, that a second subframe group is carried by the first subframe group and so forth in a hierarchic order, and wherein the resonance frequency range of the apparatus increases with the number of subframe groups.

4. The apparatus of claim 3, wherein said primary strut members and said secondary strut members have dimensions which diminish with a constant factor from the primary strut members to the secondary strut members of the first subframe group and so forth whereby the same size relationship exists between adjacent groups.

5. The apparatus of claim 1, further comprising antihum coating means operatively secured to said cover means.

6. The apparatus of claim 1, further comprising clamped-in coating means operatively secured to said cover means.

7. The apparatus of claim 1, wherein a plurality of such resonance means are interconnected to cover a surface.

* * * * *